United States Patent [19]

Schuh

[11] Patent Number: 4,629,012

[45] Date of Patent: Dec. 16, 1986

[54] DRAINHOLE DRILLING ASSEMBLY

[75] Inventor: Frank J. Schuh, Plano, Tex.

[73] Assignee: Atlantic Richfield Company, Plano, Tex.

[21] Appl. No.: 752,609

[22] Filed: Jul. 8, 1985

[51] Int. Cl.[4] ..... E21B 7/08

[52] U.S. Cl. ..... 175/75; 175/61

[58] Field of Search ..... 175/75, 76, 73, 61, 175/62, 325, 326

[56] References Cited

U.S. PATENT DOCUMENTS

| | | | |
|---|---|---|---|
| 550,783 | 12/1895 | Elliott et al. | 175/75 |
| 2,664,270 | 12/1953 | Zublin | 175/75 |
| 2,669,428 | 2/1954 | Zublin | 175/75 |
| 2,669,429 | 2/1954 | Zublin | 175/75 |
| 3,893,523 | 7/1975 | Jetter | 175/75 X |

*Primary Examiner*—Stephen J. Novosad
*Assistant Examiner*—Thuy M. Bui
*Attorney, Agent, or Firm*—Wofford, Fails & Zobal

[57] ABSTRACT

An improvement in a drainhole drilling assembly having the usual drilling motor for rotating a drillbit and a drillbit connected with the motor for drilling through the subterranean formations to form a curved borehole penetrating a particular horizontal stratum. The improvement is characterized by a non-rotating, pre-bent, stabilized, curved outer rigid metallic case having in normal repose a first predetermined radius of curvature and a rigid tubular inner metallic shaft journalled for rotation within the curved rigid metallic case and connected with the drilling motor and the drillbit so as to transmit torque from the drilling motor to the drillbit. The rigid metallic shaft is normally straight and is forced interiorly of the curved rigid metallic case to become bent and in the process cause the curved rigid metallic case to have a second predetermined radius of curvature greater that the first predetermined radius of curvature. The rigid inner metallic shaft is forcibly flexed in rotation to transmit the torque from the drilling motor to the drillbit. Also disclosed are specific preferred embodiments having examples illustrating the assembly.

10 Claims, 3 Drawing Figures

DRAINHOLE DRILLING ASSEMBLY

FIELD OF THE INVENTION

This invention relates to the drilling of boreholes that penetrate the subterranean formations in a nearly horizontal traverse. More particularly, it relates to a drilling assembly for the drilling of such horizontal boreholes, commonly referred to "drainholes," for increasing production of fluids; such as oil, gas and the like; from the subterranean stratum in which they have the horizontal traverse, as well as for other purposes.

DESCRIPTION OF THE PRIOR ART

The art of drilling inclined boreholes, or boreholes that penetrate through the subterranean formation at angles other than substantially vertical, has advanced significantly over the years. One innovation that has become particularly useful in increasing the production of fluids has been the use of drainholes in which the borehole penetrates substantially horizontally through a particular subterranean stratum to drain the fluids therefrom more effectively than the small diameter vertical boreholes that usually penetrate through the sometimes thin formation. Sometimes these target formations are only about 10 feet or so and may be at significant depth, for example, six to seven thousand feet or deeper. As will be appreciated, only a 10 percent error, priorly thought to be adequate drilling accuracy in deviating a well, would result in an error of sixty to seventy feet and might even completely miss the horizontal formation intended to be drilled. Consequently, it has become apparent that greater accuracy and control has been needed. The prior art has seen the use of relatively flexible bent subs or bent housings with downhole motors interiorly thereof to create what are referred to as "build intervals," or angled drilling intervals, so as to penetrate the horizontal strata. These relatively non-rigid outer subs, or housings, and the downhole motors therewithin have been susceptible to being deviated by relatively hard sections of non-uniform formations being penetrated.

Specifically, one of the major problems in drilling medium radius and conventional curvature drainholes is the obvious need to be capable of building hole angles at a predictable rate with minimum variations. This is especially true for the conventional curvature rate for the hole, such as the Sadlerochit drainhole. In this instance, just typical of many others that will probably be employed, the target horizontal depth may be narrowly defined and require the well designer select the kickoff point and the build rates to reach the desired stratum in a substantially horizontal position. For example, the build rate may be from two and one-half degrees per one hundred feet (2½°/100') to 50°/100'. For 2½°/100' the radius of curvature of the hole may be about 2300 feet. On the other hand, it is not uncommon to target drilling with a 300 foot radius, obtaining roughly 20° per 100 foot build angle. In the past this has required the use of flexible connections to join the essentially straight sections of the downhole motor and the Monitoring While Drilling (MWD) assemblies and still fit in the curved borehole. Inclusion of these flexible sections has weakened the resistance of the drilling assembly to being deviated and has increased the difficulty of hitting the desired interval, or stratum, in a horizontal configaration.

There are a wide variety of articles, advertising pamphlets and even patents on this subject. Typical of the articles are the following: "Lateral Drain Hole Drilling"; H. John Eastman, The Petroleum Engineer, November, 1954, page 422, B-58 et seq.; and December 1954, p. R-44 et seq.

In addition to this early discussion in the literature, the techniques continue to be developed today and the articles are illustrated by the following: "A Technique for Continuously Controlled Directional Drilling;" R. Feenstra and A. W. Kamp; 1984 Drilling Technology Conference of the International Association of Drilling Contractors, March 1921, Houston, Tex. 77210, Royal Dutchshell ENP Laboratories, that publication containing some 22 other references and appendices, illustrating the urgency of the problems and the lack of final satisfactory solutions.

Illustrative of the patent literature on this subject is U.S. Pat. No. 3,398,804; "Method of Drilling a Curved Borehole;" D. R. Holbert, issued Aug. 27, 1968.

From the foregoing it can be seen that the prior art has not provided a totally satisfactory solution to the problems inherent in producing a substantially horizontal drainhole penetrating in a substantially horizontal traverse a particular horizontal stratum of a subterranean formation for draining subterranean fluids therefrom.

SUMMARY OF THE INVENTION

Accordingly, it is an object of this invention to provide an improved assembly for drilling a substantially horizontal drainhole and the requisite curved portion of the borehole attendant to getting to the particular horizontal stratum in the horizontal configuration.

It is a particular object of this invention to provide a rigid outer case with an interior rigid shaft that can be oriented to drill a curved borehole accurately and with minimal deviation in order to increase the accuracy of penetrating a particular horizontal stratum of the subterranean formation, while obviating the disadvantages of the prior art.

These and other objects will become apparent from the descriptive matter hereinafter, particularly when taken in conjunction with the appended drawings.

In accordance with this invention there is provided an improvement in an assembly for drilling from the surface a borehole penetrating subterranean formations and including a curved borehole section to terminate substantially horizontal in a predetermined stratum for forming a drainhole facillitating flow of subterranean fluids from the stratum. The assembly includes the conventional drilling motor means for rotating a drillbit means and a drillbit means connected with the drilling motor means for drilling through the subterranean formation to advanced toward the stratum. The improvement is characterized by a non-rotating, pre-bent stabilized, curved outer rigid metallic case disposed intermediate the drilling motor means and the drillbit means and having in normal repose a first predetermined radius of curvature; and a rigid tubular inner metallic shaft journalled for rotation within the curved rigid metallic case and connecting the drilling motor means with the drillbit means so as to transmit torque from the drilling motor means to the drillbit means. The rigid metallic shaft is normally straight and is forced interiorly of the curved rigid metallic case to become bent in the process and to cause a slight straightening of the rigid metallic case so that it has a second predetermined radius of curvature greater than the first predetermined radius of curvature. The rigid inner metallic shaft is thus forcibly flexed in rotation to transmit the torque from the drilling motor means to the drillbit means.

Also disclosed are preferred embodiments in which bearings are interposed intermediate the shaft and the case and in which a lubricant is enclosed in the chamber defined by the annular space between the shaft and the case.

DESCRIPTION OF THE PREFERRED EMBODIMENTS

This invention provides a curved rigid assembly that can be run through a straight section of borehole with only tolerable drag, that forms a curved borehole and that, in the curved borehole, provides greater resistance to being deflected or deviated by a zone of hardness in non-uniform subterranean formations or the like and, thus, provides greater accuracy in hitting a particulary horizontal stratum.

Figure 1:
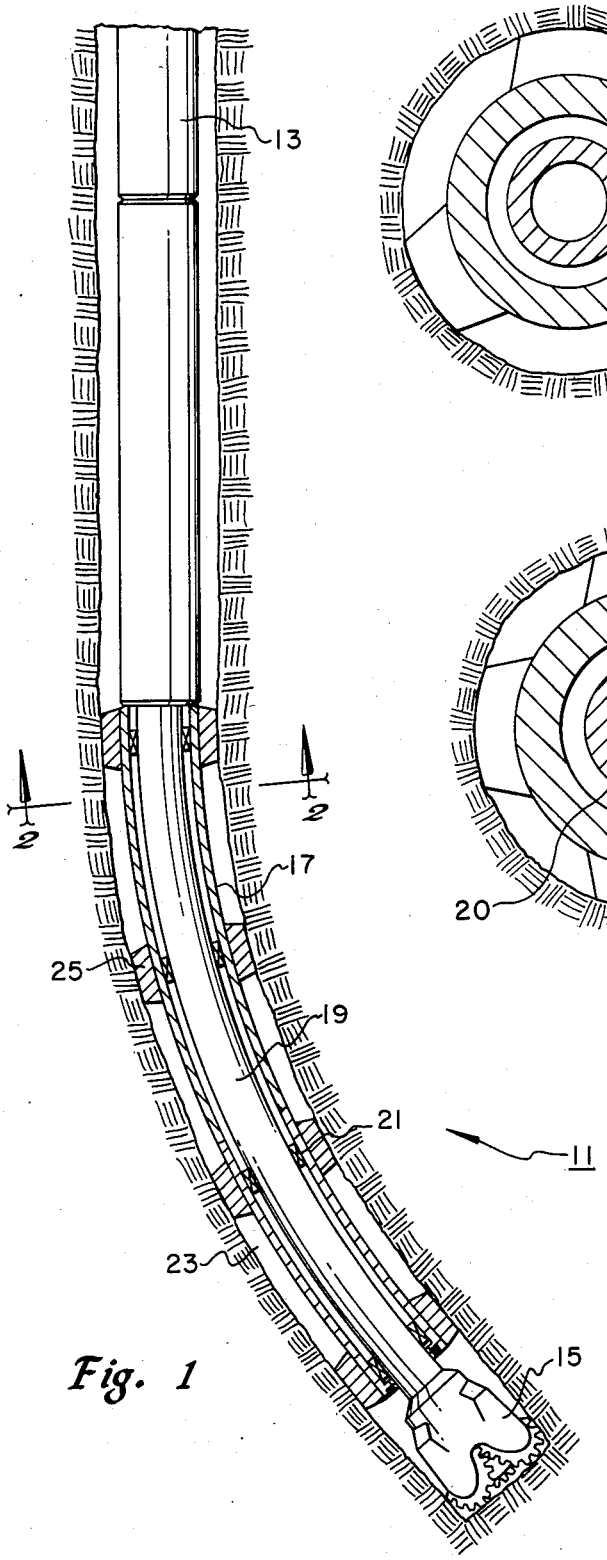
FIG. 1 illustrates a drilling assembly for drilling a curved borehole to penetrate a subterranean formation for terminating in a horizontal drainhole facillitating flow of subterranean fluids from the stratum.

More particularly, this invention is particularly useful for drilling sections of the hole called "build intervals" at depths in the subterranean formation in order to reach a particular horizontal stratum. For example, it may be used for drilling the so-called low radius curvature, the medium, or even the high radius curvature drilling for creating the desired build intervals at desired depths, ranging from only a few hundred feet above particular horizontal stratum to several thousand feet or more above a particular horizontal stratum. To further illustrate, it may be employed for drilling curved borehole section with angles of from 2° per 100 foot to 50° per 100 foot or more. The invention may be more nearly completely understood by referring to the FIG. 1 which illustrates the improved drilling assembly. Therein, the drilling assembly 11 includes the usual drilling motor means 13 for rotating a drillbit means; and the drillbit means 15 that is connected with the drilling motor means for drilling the subterranean formation to advance torward the particular desired stratum. The improved drilling assembly 11 also includes a non-rotating, pre-bent, stabilized, curved outer rigid metallic case 17 disposed intermediate the drilling motor means and the drillbit means; and a rigid tubular inner metallic shaft 19 for transmitting torque from the drilling motor means to the drillbit means 15.

The drilling motor means 13 may comprise any of the conventional types of downhole motors. For example, it may be a fluid driven turbine or other conventional motor that is conventionally available and conventionally employed. In any event, it does not need to be described in detail herein. Typical of such downhole motors are the positive displacement motors commercially available from DYNA-DRILL which have long been recognized as economical tools for drilling responsive to flow of drilling mud therethrough. Such DYNA-DRILL motors operate with bit pressure drops of up to 500 pounds per square inch, PSI, or even 1,000 PSI and supply torque needed for rotating the bit in any particular subterranean formation to be drilled.

Similarly, the particular drillbit means 15 is well recognized and may comprise any of the conventionally available drillbits depending upon the particular subterranean formation being drilled.

These bits traverse the types from the multiple cone rotary bits to drag bits, impact bits or the like. Ordinarily the illustrated rock bits, having a plurality of respective rock crushing cones thereon, are preferred.

The bit may have connected immediately behind it a reamer for reaming a particular hole diameter. Even if a reamer is interposed between the bit and bit means 15 and the motor means 15, the particular hole is drilled, with or without reaming, to the desired diameter through torque transmission from the drill motor means to the drillbit means 15.

The drilling motor means 13 may be connected to an optional but preferred bent flexible knuckle or similar conventional housing, or sub, which is adapted to urge or cause the bit to drift in the build direction in a relatively controlled curve angle. On the other hand, there can be employed whipstocks or similar arrangements, such as illustrated in U.S. Pat. No. 3,398,804, to initiate a curved build portion of the borehole.

The non-rotating, pre-bent, stabilized, curved outer rigid metallic case 17 that is disposed intermediate the drilling motor means and the drillbit means may be connected into the drilling string by any of the conventional means such as particular drill joints or collars. The mode of connection may be any of those conventionally employed, such as upset tubing threads or the like. It is preferred to form a sealed outer chamber that can be employed to hold a lubricant, as will be described in more detail hereinafter. Moreover, special subs and drill collars that do not ordinarily rotate with the drillbit 15 act as conductors or guides for forcing the drillbit means to penetrate out of the main borehole toward the particular build direction to follow a curved course toward the horizontal.

The curved rigid metallic case 17 has in normal repose a first predetermined radius of curvature. For example, a typical rigid outer case may have an outside dimensions of 4½ inches outside diameter with a 4 inch internal diameter chamber therewithin. The outer case might have an initial radius of curvature of 236 feet radius in normal repose before the rigid tubular inner metallic shaft is forced interiorly thereof. Thus, the sub could be moved, through a straight portion of borehole with tolerable drag; for example, lowered to a particular curved interval borehole, and oriented to penetrate through the curved interval easily.

While it is easiest to make the outer case from circular cross-sectional material, it is readily apparent that any other cross-sectional shape could be employed if desired. For example, to resist torsional rotation, the outer case may be elliptical in cross-sectional shape with its major axis of the ellipse at least 20% greater than the minor axis of the ellipse. This increases the stiffening and resistance to rotation in response to any torsional force that might be enacted on the bent casing.

Figure 2B:
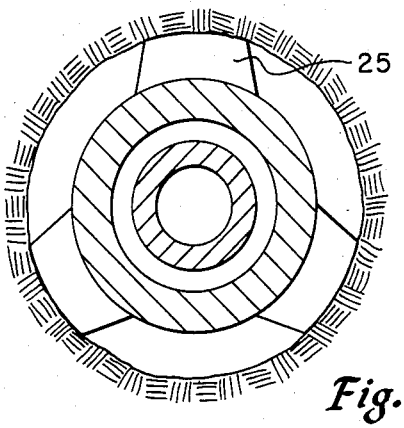
FIG. 2*b* is a similar cross-sectional view showing only three centralizers.
Figure 2A:
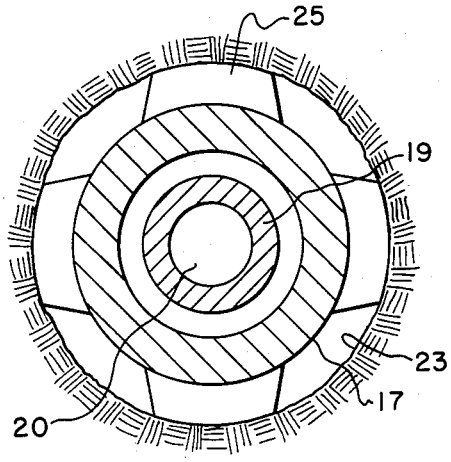
FIG. 2*a* is a cross-sectional view taken along the lines 2—2 of FIG. 1, showing four centralizers.

As illustrated in the Figures, the central rigid metallic shaft 19 is circular in cross-section and fits within a substantially circular cross-section chamber 23, regardless of the outer shape of the bent housing or case 17. As can be seen in FIG. 2*a*, the tubular shaft 19 has a central aperture 20 through which flows the drilling fluid and has four stabilizers 25 at each location. FIG. 2b illustrates using three stabilizers 25 at each location.

The rigid tubular inner metallic shaft 19 is journalled for rotation within the curved rigid metallic case 17 and is connected with the drilling motor means and the drillbit means so as to transmit torque from the drilling motor means to the drillbit means. The rigid metallic tubular shaft 19 is normally straight and is forced interiorly of the curved rigid metallic case to become bent; and, in the process, causes some straightening of the curved rigid metallic case. Expressed otherwise, the forcing interiorly of the normally straight tubular metallic rigid shaft causes the curved rigid metallic case to have a second predetermined radius of curvature once the shaft is inserted that is greater than the first predetermined radius of curvature. For example, a $2\frac{7}{8}$ inch by 2.441 inch pipe may be employed as the shaft and inserted within an outer $4\frac{1}{2}$ inch O.D. curved outer case having a 236 foot radius of curvature to cause the final radius of curvature to be 286 feet. This is the desired curvature for achieving 20° per 100 foot curvature rate.

The reverse bending stresses in $2\frac{7}{8}$ inch drill pipe such as delineated above are quite low. Yet, the rigid tubular inner metallic shaft can transmit the torque quite adaquately between the drilling motor means 13 and the drillbit means 15.

If desired and preferably, suitable bearings 21 are interposed longitudinally along the inner shaft to facillitate rotation of the shaft responsive to the rotary part of the drilling motor means 13.

For example, the drilling motor means 13 will normally have an outer case and the central portion of the drilling motor means 13 will have a rotary drive. The pre-bent, rigid outer case is attached to the case of the drilling motor means and the rigid inner metallic shaft is normally attached to the rotary drive and is journalled for rotation within the curved rigid metallic case.

The bearings placed between the rigid tubular inner metallic shaft 19 and the curved rigid metallic case 17 can be lubricated prior to each bit run if desired. If desired, on the other hand, the chamber 23 defined by the annular space between the tubular inner shaft 19 and the curved rigid metallic case 17 can be filled with a lubricant, since it is preferred that the chamber be sealed and isolated from drilling mud in any event. The sealing of such chambers is conventional in this art and need not be described in detail, since any of the conventional means could be employed herein to accomodate the relative rotary motion between the rigid inner metallic shaft 19 and the rigid curved outer case 17.

Conventional centralizers 25 are employed with this invention.

It is preferable to employ separate sub or subs with a pivot point above the bit-reamer to urge the bit in the proper direction. In some cases, however, the separate sub or subs may be omitted. In such cases, the drill collar may be appropriately formed of bent or flexed jointed subs to urge the bit and reamer in the desired build direction at the desired angle of curvature.

In operation, a main, or vertical, borehole is drilled in conventional manner to a point where the hole is to be deviated into a drainhole. At this depth, a drillbit such as the drillbit means 15, is connected with the shaft 19, either directly or by way of a reamer (not shown). The drilling motor means 13 is, in turn, connected to the usual sub or bent collar. If a sub is used, the uppermost sub is connected to the drill collar with or without intermediate members. If desired, a whipstock may be lowered into the hole and oriented in the borehole first and set in the desired location and pointing the desired direction. The drilling assembly is lowered into the borehole to the desired point with the bent sub or bent drill collar oriented in the preselected direction. The bent rigid outer case resists twisting and disorientation of the drilling assembly. It is particularly resistant when it is formed of an elliptical cross-sectional shape.

When drilling is renewed and weight is placed on the bit by the drill string or drill collar, the bent case (with or without the aid of a whipstock) urges the bit to penetrate out the main hole toward the desired azimuth of the curvature. As the bit is rotated, it cuts the side pocket in the vertical bore and the drilling assembly is steered with a line of axis of the bit and a reamer if attached. As weight is maintained on the bit by feeding drill string into the bore at the surface, the bit is crowded outward and downward out of the original hole due to side pressure caused by the bent rigid case 17 (with or without the whipstock). The bent outer case and any other bent subs or collars follow the bit into the deviated, curving borehole. The bent outer case and any attached drill collars are not rotated. The inner shaft 19 is, of course, rotated by the torque from the drilling motor means 13. The bent outer case resists the torque forces and adds stability to the system, reducing the chances of over drilling either right or left of the intended target. It also aids in preventing undesirable vertical deviations. Yet, the force of running the curved rigid outer case in the borehole does not pose an intolerable drag force. For example, for a three foot spacing, the calculation indicates a total drag of only 1336 pounds, which is relatively insignificant in the overall weight of a drill string drilling deeply into subterranean formations.

If desired a more elongate section of curved borehole can be employed advantageously with the curved drilling assembly.

In summary, the advantages of this approach is to provide a curved assembly that, in a curved borehole, provides bore resistance to natural formation forces that tend to deflect the bit from the desired advancing path of a building section of a borehole. The critical parameters that need to be considered to compare this design with prior art are the stiffness of this assembly in bending compared to the stiffness of the prior curved motor cases and the stiffness of the flexible members that have been used heretofore to transmit the torque to the drilling bit assembly.

Another advantage is that, since this invention has minimal internal working parts compared to a motor, there is more space for a larger and stiffer outer case to provide more nearly continuous stabilization to the sides of the borehole. This is significantly better than assemblies where the relatively long legs of the downhole motor section must be maintained straight. No flexible connnections have to be added to this assembly to permit control of stress during installation and withdrawal from even the vertical part of the hole.

Moreover, this invention can be employed to drill elongate sections of curved borehole such as might be employed even from the surface.

From the foregoing it can be seen that this invention achieves the objects delineated hereinbefore.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. In an assembly for drilling from the surface a borehole penetrating subterranean formations and including a curved borehole section to terminate in a predetermined horizontal stratum for forming a drainhole facilitating flow of subterranean fluids from the stratum, the assembly including:

a. a drilling motor means for rotating a drillbit means;

b. a drillbit means for drilling the subteranean formation to advance toward the stratum, the drillbit means being connected with said drilling motor means; the improvement comprising:

c. a non-rotating, pre-bent, stabilized, curved, outer rigid metallic case disposed intermediate said drilling motor means and said drillbit means and having in normal repose a first predetermined radius of curvature; and d. a rigid tubular metallic shaft journalled for rotation within said curved rigid metallic case and connecting said drilling motor means with the said drillbit means so as to transfer torque from said drilling motor means to said drillbit means; said rigid metallic shaft being normally straight and forced interiorly of said curved rigid metallic case to become bent in the process and causing said curved rigid metallic case to have a second predetermined radius of curvature greater than said first predetermined radius of curvature; said rigid inner metallic shaft consisting essentially of a unitary, non-articulated member throughout said case; being forcibly flexed in rotation; and serving to transmit torque from said drilling motor means to said drillbit means.

2. The drilling assembly of claim 1 wherein bearings are disposed intermediate said shaft and said case at a plurality of longitudinally spaced apart locations along said shaft to facilitate rotation of said shaft.

3. The drilling assembly of claim 1 wherein said case is circular in cross-sectional shape with a circular chamber in which said tubular shaft is disposed and said tubular shaft is substantially circular in shape.

4. The drilling assembly of claim 3 wherein said circular shaped case and said cylindrical tubular shaft are substantially concentrically arranged with said shaft interiorly of said case.

5. The drilling assembly of claim 1 wherein said case is substantially elliptical in cross-sectional shape with a cylindrical tubular shaft disposed in a chamber that is substantially cylindrical in cross-sectional shape.

6. The drilling assembly of claim 5 wherein said cylindrical chamber in said eliptical shaped case and said cylindrical tubular shaft are substantially concentrically arranged.

7. The drilling assembly of claim 1 wherein said drilling motor means has an outer case and rotary drive and said pre-bent outer case is attached to said case of said drilling motors means and said rigid inner metallic shaft is attached to said rotary drive.

8. The drilling assembly of claim 7 wherein said shaft is disposed within an inner chamber within said pre-bent outer case, bearings are disposed intermediate said shaft and said case at a plurality of longitudinally spaced apart locations along said shaft to facillitate rotation; and wherein a lubricant is sealingly retained within said inner chamber and lubricates said bearings.

9. The drilling assembly of claim 7 wherein said shaft is disposed within an inner chamber within said pre-bent outer case; and wherein lubricant is sealingly retained within said inner chamber.

10. The drilling assembly of claim 1 wherein a monitoring while drilling collar is included and is connected with said drilling motor means and is monitored at the surface to afford knowledge of orientation of said drilling motor means and said pre-bent curved outer rigid metallic case.

* * * * *